United States Patent [19]

Maciejewski

[11] Patent Number: 4,656,710

[45] Date of Patent: Apr. 14, 1987

[54] METHOD OF MAKING A HYDRAULIC PUMP HOUSING

[76] Inventor: Noman Maciejewski, 2354 Eastbrook, Toledo, Ohio 43613

[21] Appl. No.: 766,515

[22] Filed: Aug. 19, 1985

[51] Int. Cl.[4] ..... B23P 15/00

[52] U.S. Cl. ..... 29/156.4 WL; 29/156.4 R; 29/157 R; 72/347; 72/379; 417/440

[58] Field of Search ..... 29/156.4 R, 156.4 WL, 29/157 R; 72/347, 379; 417/440

[56] References Cited

PUBLICATIONS

"Deep Drawing", *Forming,* 8 Metals Handbook (8th edition) 162, American Society for Metals (1969).

*Primary Examiner*—Howard N. Goldberg
*Assistant Examiner*—Ronald S. Wallace
*Attorney, Agent, or Firm*—Marshall & Melhorn

[57] ABSTRACT

A housing assembly for a hydraulic pump unit utilized in motor vehicles wherein a housing body is deep drawn from a circular blank of a typically high strength, low alloy steel. A drawn elongate valve sleeve is attached to the housing body by a stamped saddle member. The valve sleeve, saddle member, and housing body are produced with appropriate fluid passages and ports for the flow of hydraulic fluid through the housing assembly.

4 Claims, 24 Drawing Figures

METHOD OF MAKING A HYDRAULIC PUMP HOUSING

BACKGROUND OF THE INVENTION

This invention generally relates to hydraulic pumps utilized in motor vehicles and, more particularly, to a novel hydraulic pump housing employed in power steering units and process for making the same.

The production of more efficient automotive vehicle components is of paramount importance in the manufacture of the vehicles. In this regard, a reduction in the weight of the component equipment for producing a more energy efficient vehicle is very desirable.

Hydraulic fluid pressurizing pumps for use in vehicle power steering systems typically employ housings formed from heavy castings of ferrous material to withstand the relatively high internal pressures which occur during the operation thereof. However, while these housings were prime candidates for a reduction in weight, it has previously been perceived to be a technically unattainable objective.

In addition to the weight factor of the pump housing castings, such materials embody the undesirable feature of the low heat energy conductivity thereby militating against the escape of heat energy during the operation of the attendant pump assembly. Obviously, the retention of heat energy within the pump assembly adversely affects the overall efficiency as well as the duty life of the assembly.

Further, it has been found that the internal design of cast housings typically exhibit rough interior surfaces which adversely affect the efficient flow of fluids during the pump operation.

SUMMARY OF THE INVENTION

The hydraulic pump housing, produced in accordance with the invention, overcomes the aforementioned disadvantages and generally comprises an elongate, substantially cylindrical body which is formed by a deep drawing operation from a circular blank and a communication sleeve assembly which is affixed to the external cylindrical surface of the body in a predetermined position. The interior surfaces of the cylindrical body are very smooth because of the drawing operation and includes an axially extending bushing support sleeve having a radially extending flange at one end. One end of the body is produced with a mounting flange for attaching the housing to a fixed support member. For convenience sake in mounting the hydraulic pump unit to a support member, the opposite end of the body may be provided with an independent mounting yoke.

Also, the invention is directed to a process for producing a hydraulic pump housing assembly wherein a substantially cylindrical elongate pump body is deep drawn from a circular blank and an elongate cylindrical valve sleeve is secured to a raised U-shaped portion of a stamped arcuate saddle member which is secured to the outer periphery of the cylindrical pump body as by tack welds.

An object of the invention is to produce a light weight, hydraulic pump housing which is simple in construction, easy to assemble, and efficient in operation.

Another object of the invention is to produce a hydraulic pump housing body wherein the interior surfaces of the body and transition curves between various zones of the body are very smooth, thus producing efficient fluid flow characteristics.

Another object of the invention is to produce a pump housing capable of efficient heat transfer from the associated pressure fluid.

BRIEF DESCRIPTION OF THE DRAWINGS

The above, as well as other objects of the invention will become readily apparent to one skilled in the art from reading the following detailed description of the preferred embodiment of the invention when considered in the light of the accompanying drawings, in which:

FIG. 6*a* shows the circular blank from which the body is formed; FIG. 6*b* illustrates a flanged cup-shaped member formed in an intermediate drawing stage from the blank illustrated in FIG. 6*a*; and FIGS. 6*c* and 6*d* are elevational and bottom plan views, respectively, of the finished drawn pump body;

FIGS. 7*a* and 7*d* are top and bottom plan views, respectively, of the saddle member; and FIGS. 7*b* and 7*c* are side and end elevational views, respectively, of the saddle member;

FIG. 9*a* illustrates a drawn sleeve member; FIG. 9*b* is a cross-sectional view of a partially machined sleeve; and FIG. 9*c* is an elevational view, partly in section, illustrating some of the ports utilized in the invention;

DETAILED DESCRIPTION OF THE PREFERRED EMBODIMENT

Figure 2:
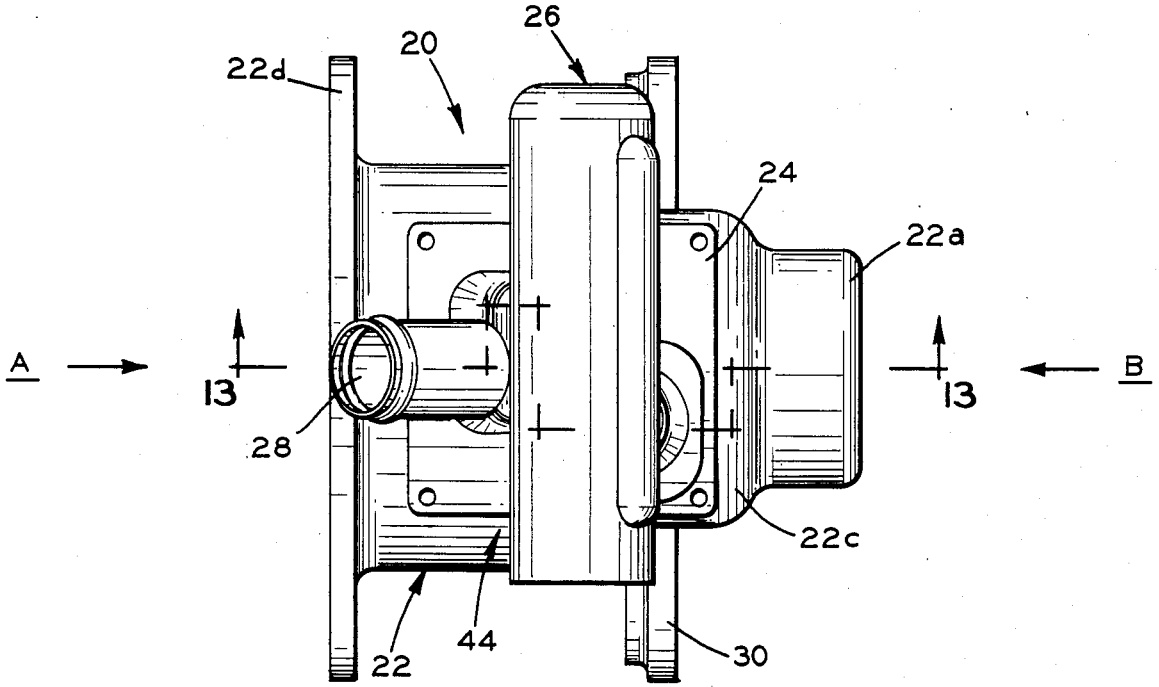
FIG. 2 is a top plan view of a hydraulic pump housing assembly constructed in accordance with the invention.
Figure 3:
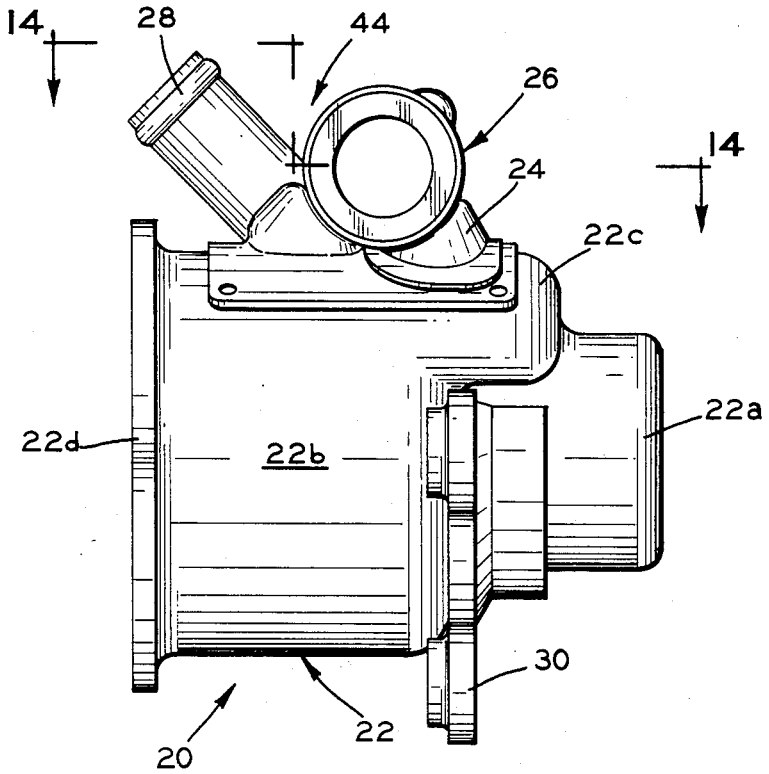
FIG. 3 is a side elevational view of the pump housing assembly illustrated in FIG. 2.

Referring now to the drawings wherein like reference numerals designate similar parts throughout, there is illustrated a novel hydraulic pump housing assembly 20 (See FIG. 2) constructed in accordance with the invention.

Figure 1:
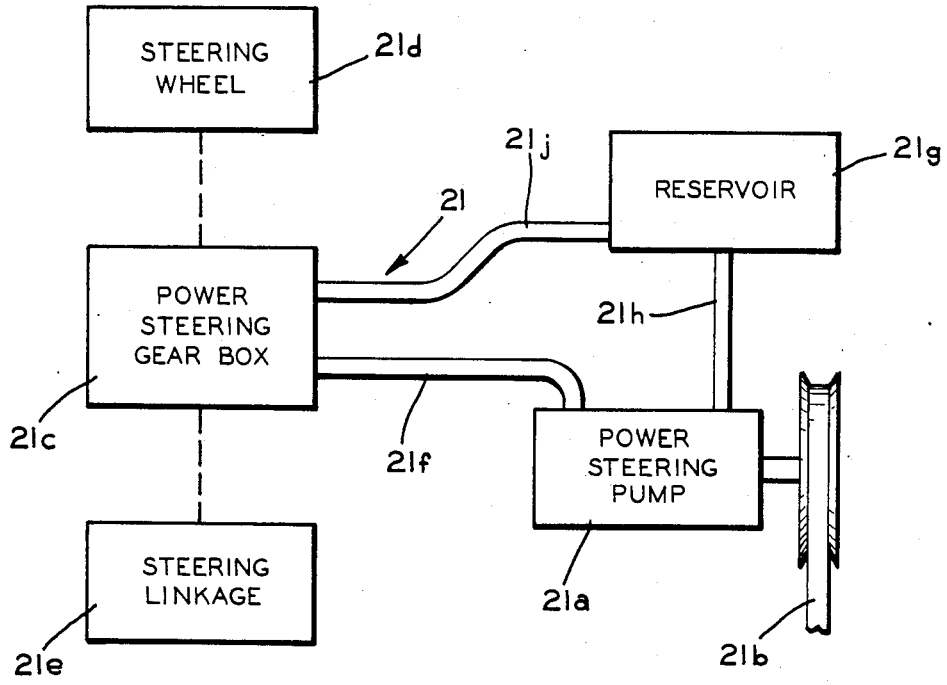
FIG. 1 is a diagrammatic view of the basic components of a conventional vehicle steering system.

A conventional power steering system 21, as illustrated in FIG. 1 includes a hydraulic pump 21*a* driven by any suitable means such as by a belt 21*b* driven from a vehicle engine (not shown). The system 21 includes a power steering gear box 21*c* which is controlled by an operator through a steering wheel 21*d* and connected to a steering linkage 21*e*. The pump 21*a* is connected to the power steering gear box 21*c* by a conduit 21*f* to supply pressurized hydraulic fluid to the power steering gear box 21*c*. An unattached hydraulic fluid reservoir 21*g* is connected to the pump 21*a* by a conduit 21*h*, and to the power steering gear box 21*c* by a conduit 21*j*. It should be noted that the reservoir 21*a* may be attach directly to the pump housing if desired.

As best illustrated in FIGS. 2 through 5, the pump housing assembly 20 generally comprises a deep drawn unitary body member 22, a saddle member 24, a valve sleeve housing assembly 26 fixedly mounted by the saddle member 24 to the body member 22, an inlet tube 28 connected to the saddle member 26 providing a fluid passageway to the valve sleeve housing 24, and a mounting yoke member 30 for securing the pump housing assembly 20 to a suitable support (not shown) within the engine compartment of an automotive vehicle.

Figure 6A:
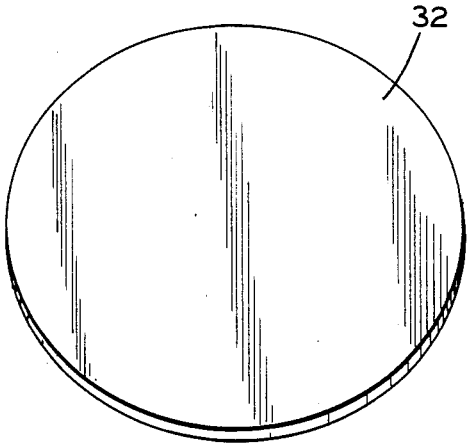
FIGS. 6*a* through 6*d* are views illustrating the formation of the drawn pump housing body utilized in the invention, and more specifically.
Figure 6B:
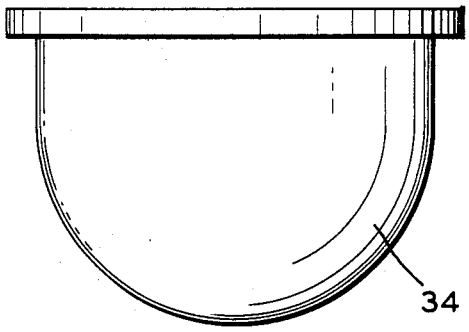
Figure 6C:
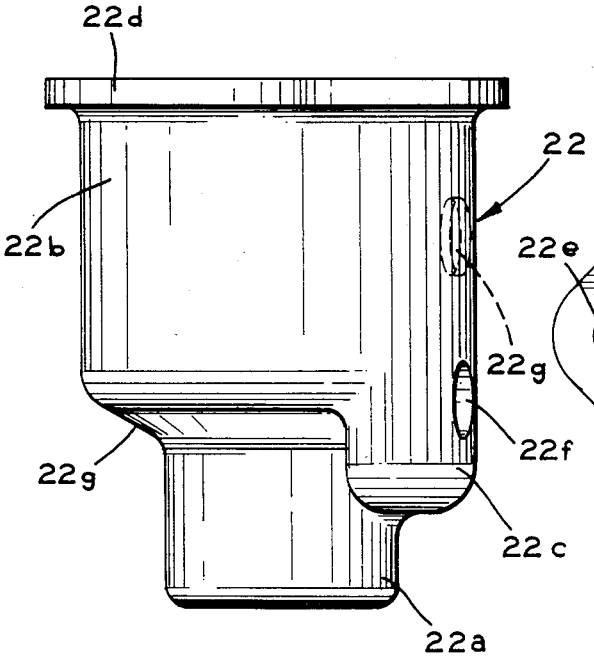

The body member 22 illustrated in FIG. 6*c*, is deep drawn in a number of stages, from a relatively thick circular blank 32 (see FIG. 6*a*) of high strength, low alloy material, such as, for example, a product of Bethleham Steel Company commercially available and referred to or identified as 935XK. The 935XK steel material generally is a low alloy carbon steel comprising in approximate weight percentages: 10 maximum carbon, 90 maximum manganese, 0.040 maximum phosphorus, 0.040 maximum sulfur, 0.030 to 0.070 aluminum, 0.020 columbium (niobium), and the balance bring iron. A suitable low alloy steel is one containing iron, a maximum of about 10% by weight of carbon and alloying elements including manganese, phosphorus, sulfur, alumnum and columbium. It has been discovered that a circular blank 32 of the above described steel material having approximate dimensions of $6\frac{3}{4}$ inches in diameter and 5/32 inches in thickness can be drawn into an elongate cylindrical body having an outside diameter of approximately 2 9/16 inches and a length of $3\frac{3}{8}$ inches. The wall thickness of the drawn cylindrical body is substantially the same as the thickness of the blank 32.

Figure 6D:
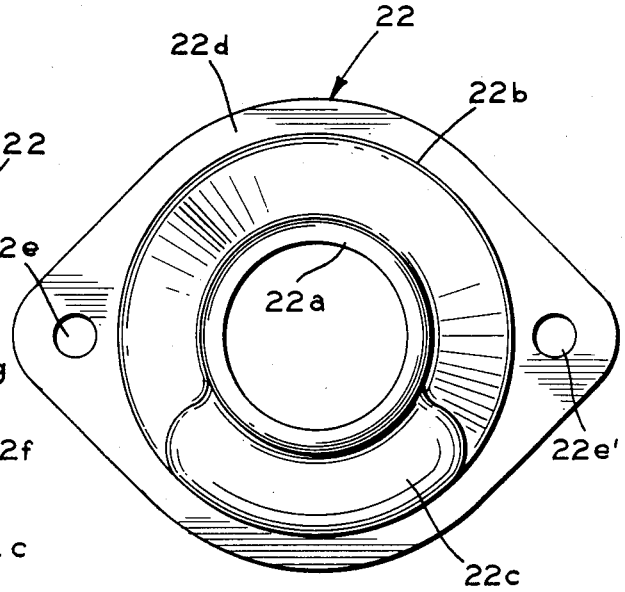
Figure 7A:
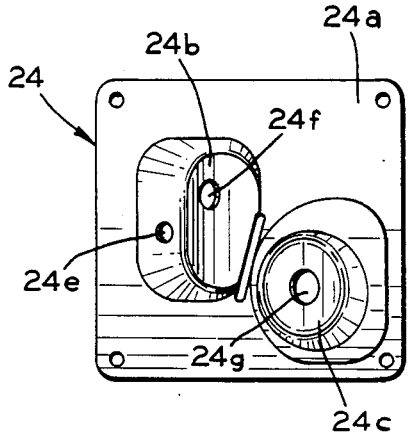
FIGS. 7*a* through 7*d* are views illustrating a stamped saddle member utilized in the invention, and more specifically.
Figure 7C:
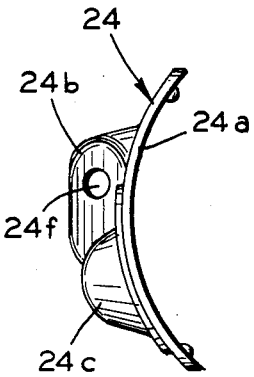
Figure 7D:
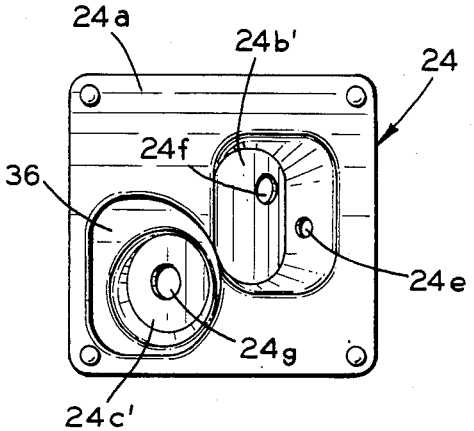
Figure 7B:
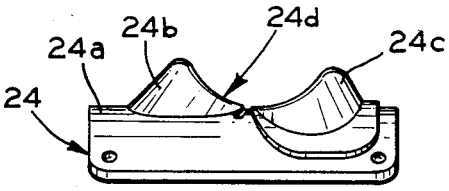

The circular blank 32 is initially drawn into a flanged cup-shaped member 34 (see FIG. 6*b*) in an appropriate number of stages. The cup-shape member 34 is then drawn, in an appropriate number of stages, into the formed body member 22 illustrated in FIGS. 6*c* and 6*d*.

The body member 22 includes a relatively small cylindrical hub portion 22*a*, and an enlarged cylindrical body portion 22*b*, an enlarged step portion 22*c* extending from the body portion 22*b* and overlying the hub portion 22*a*, and a flange portion 22*d* having a pair of diametrically opposed mounting holes 22*e*, 22*e*'. A discharge port hole 22*f* (see FIG. 6*c*) is disposed between the large cylindrical portion 22*b* and the step portion 22*c* and an intake port hole 22*g* is disposed in the large cylindrical portion 22*b*, the purposes of which will be described hereinafter. It should be noted that the interior surfaces of such a drawn body as well as the surfaces of the transition curves between the various portions of the body 22 are smooth and enhance the flow of hydraulic fluid therethrough without resultant eddy currents in the flow.

The saddle member 24, as best illustrated in FIGS. 7*a* through 7*d* generally comprises a stamped arcuate plate member 24*a* whose inner arcuate surface conforms to the outer surface of the cylindrical portion 22*b* of the body 22. A pair of offset raised portions 24*b* and 24*c* are stamped in the arcuate plate 24*a* to project from the convex surface of the arcuate plate 24*a* and form a semi-cylindrical saddle portion 24*d* (see FIG. 6*b*), the purpose of which will be described hereinafter. The inner surface of the raised portions 24*b* and 24*c* define cavities 24*b* and 24*c* (See FIG. 7*d*). The raised portions 24*b* includes a pair of apertures 24*e* and 24*f* and the raised portion 24*c* includes an aperture 24*g*, the purposes of which will be described hereinafter.

Figure 8A:
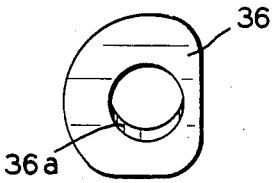
FIGS. 8*a* and 8*b* are plan and elevational views, respectively, illustrating a cavity closure member which isolates one cavity from the other in the saddle member.
Figure 8B:
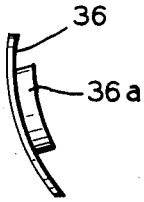

An arcuate cavity closing plate 36, illustrated in FIGS. 8*a* and 8*b* , is fixedly secured, as by welding, to the concave surface surrounding the cavity 24*c*' of the saddle member 24 to isolate the cavity 24*c*' from the cavity 24*b*' the purpose of which will be described hereinafter. The cavity closing plate 36 includes an apertured hub 36*a* which projects into the port hole 22*f* of the body 22. It should be noted that the cavity closing plate 36 is not secured to the saddle member 24 at this time.

Figure 9A:
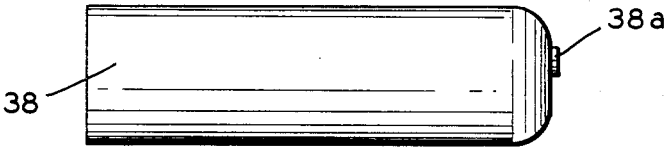
FIGS. 9*a* through 9*c* are detail views of a valve sleeve utilized in the invention, and more specifically.
Figure 9B:
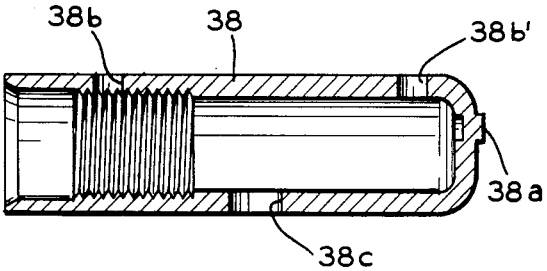
Figure 9C:
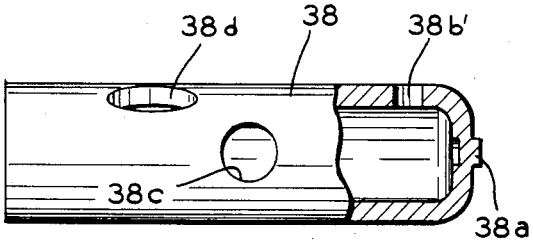

Referring to FIGS. 9*a* to 9*c*, an elongated cylindrical valve sleeve 38 having a closed end is drawn in an appropriate number of stages from a blank (not shown) and includes a raised orientation projection 38*a*extending from the closed end, the purpose of which will be described hereinafter. The valve sleeve 38 includes a pair of longitudinally aligned port holes 38*b*, 38*b*'. The valve sleeve 38 includes an aperture 38*c* and an aperture 38*d* which apertures are oriented to cooperate with the apertures 24*f* and 24*g* in the saddle member 24, respectively. The valve sleeve may be finished as shown in FIG. 9*b* and receives a longitudinally movable compensating valve member (not shown).

Figure 10:
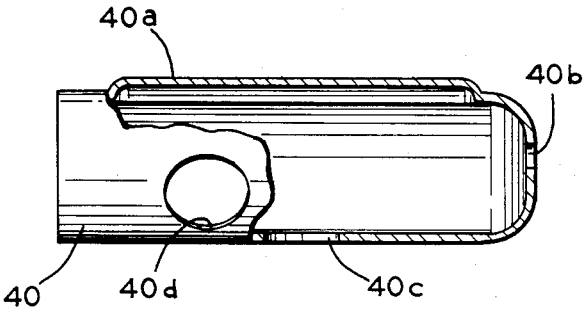
FIG. 10 is an elevational view, partly in section, illustrating the communication sleeve which encases the valve sleeve.

A cylindrical communication sleeve 40 having a closed end, a longitudinally extending raised portion 40*a* and an orientation aperture 40*b*in the closed end is illustrated in FIG. 10. The sleeve 40 is provided with an aperture 40*c* and an aperture 40*d* which have the same orientation as the apertures 38*c* and 38*d*, respectively, in the valve sleeve 38.

Figure 11:
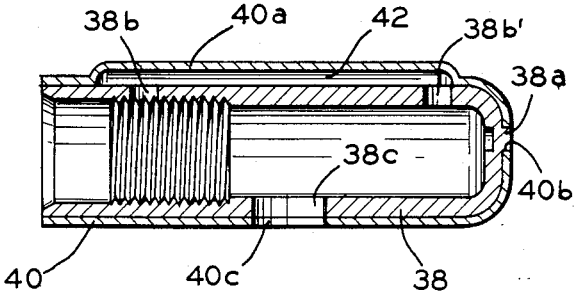
FIG. 11 is a cross-sectional side elevational view illustrating the assembled relation of the valve sleeve and the communication sleeve illustrated in FIGS. 9 and 10, respectively.

As illustrated in FIG. 11, the valve sleeve housing assembly 26 is assembled by inserting the valve sleeve 38 into the communication sleeve 40 with the orientation projection 38*a*projecting into the orientation aperture 40*b*. a communication passage 42 between the apertures 38*b*, 38*b*'. The passage 42 provides a path for hydraulic fluid to flow to and from each side of the compensating valve member (not shown). The apertures 40*c* and 40*b* of the communication sleeve 40 are adapted to be aligned with the apertures 38*d* and 38*c* of the valve sleeve 38.

Figure 15:
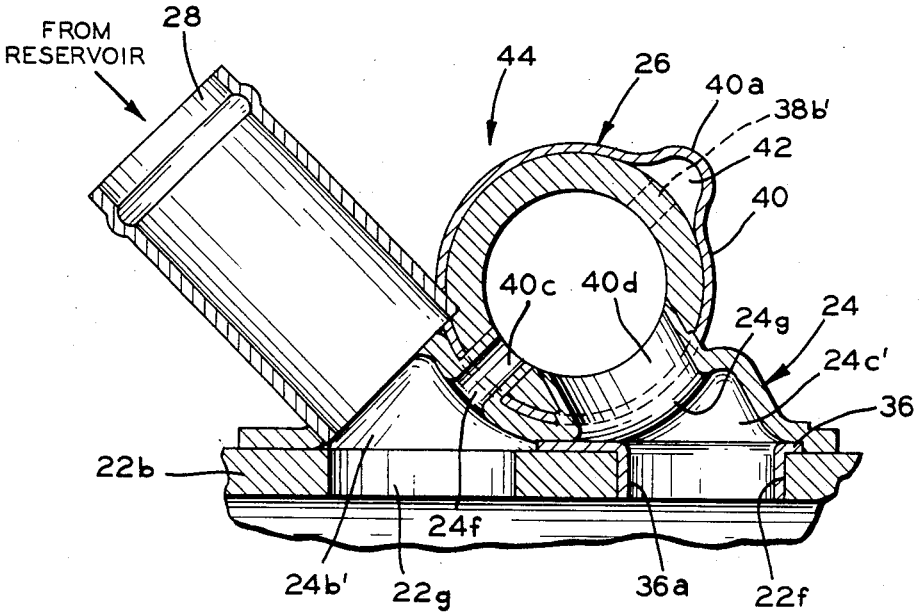
FIG. 15 is an enlarged fragmentary cross-sectional view of the connection of the valve sleeve assembly to the saddle member of FIGS. 7*a* through 7*d*.
Figure 13:
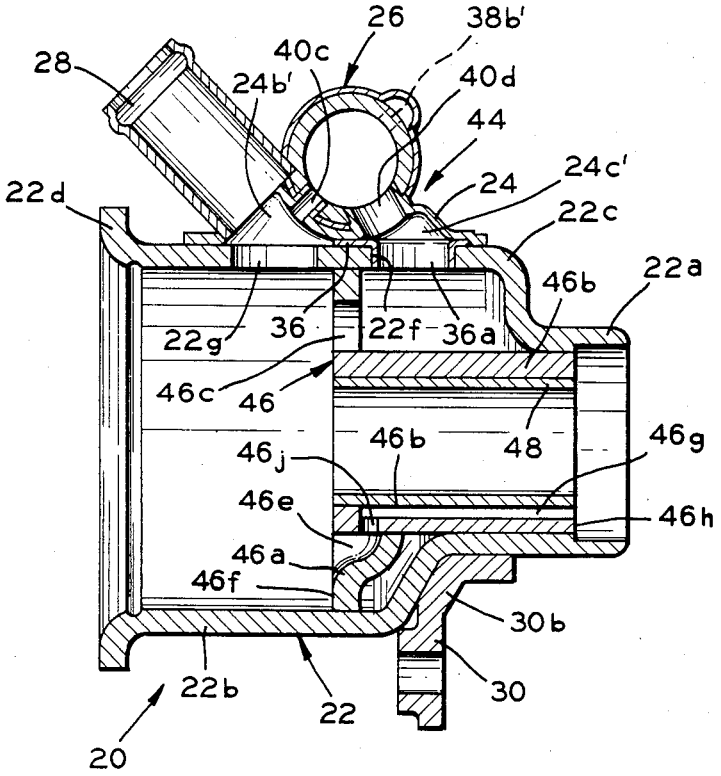
FIG. 13 is a cross-sectional view taken substantially along line 13—13 in FIG. 1.

As illustrated in FIGS. 13 and 15, the valve sleeve housing 26 is attached to the saddle member 24 by extruding the material surrounding the apertures 24*f* and 24*g* into the apertures 40*c* and 40*d*, respectively (See FIG. 15), and trimming any excess extruded material from the bore of the valve sleeve assembly 26 for permitting a compensating valve member (not shown) to move freely to and fro in the valve sleeve bore. The cavity plate 36 is now secured to the saddle member 24 to isolate the two cavities from each other as previously described.

The inlet tube 28 is adapted to be inserted into the aperture 24e of the saddle member 24 and staked thereto from the bottom side of the saddle member 24 and forms an inlet valve sleeve and saddle assembly 44.

Referring particularly to FIGS. 2, 3, 5, 12 and 13, when the yoke member 30 is employed to mount the pump housing assembly in a vehicle engine compartment (not shown), it is mounted on the hub portion 22a of the body 22 and fixedly secured thereto as by resistance welding for example. More specifically, the yoke member 30 includes a semi-annular ring segment 30a which extends substantially around the exterior periphery of the cylindrical hub 22a. Accordingly, the yoke 30 is mounted on the cylindrical hub portion 22a from the end thereof and the annular segment 30a surrounding the hub 22a holds the yoke 30 on the body 22 prior to being secured thereto. As best illustrated in FIG. 13, the yoke 30 includes a portion 30b which cooperated with a like surface 22g of the body 22 for snugly supporting the yoke 30 when the yoke 30 is attached to the body 22.

Figure 4:
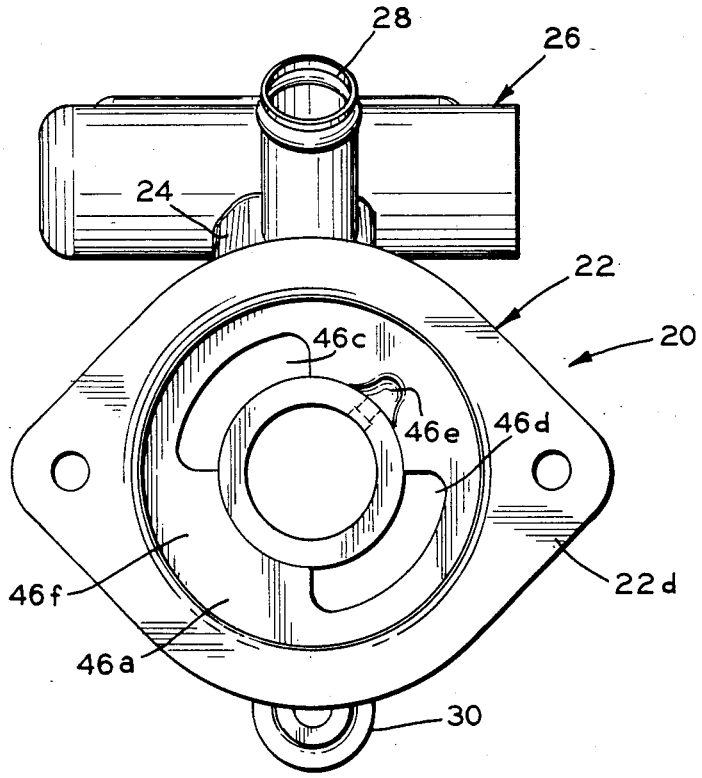
FIG. 4 is an end elevational view looking in the direction of arrow A in FIG. 2.
Figure 5:
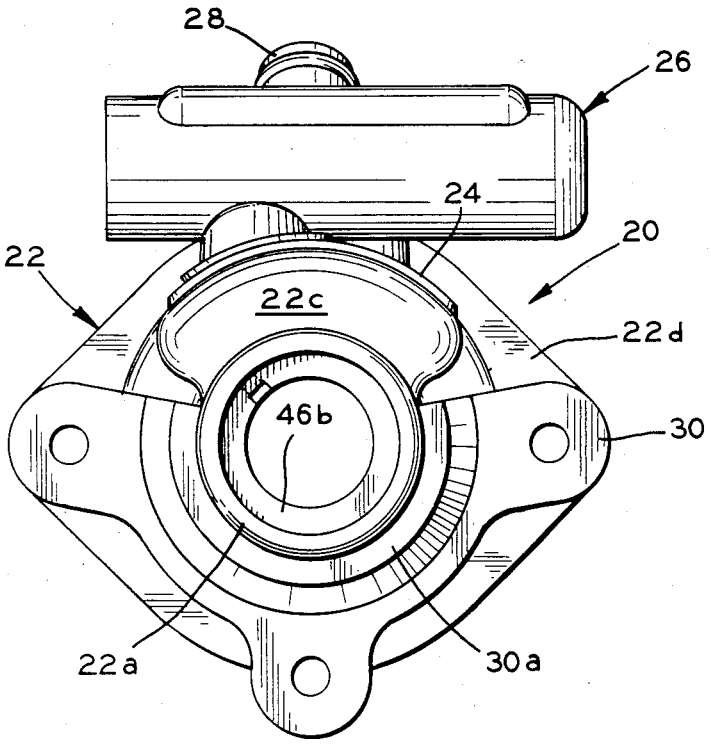
FIG. 5 is an end elevational view looking in the direction of arrow B in FIG. 2.

A bushing support member 46 is pressed into the interior of the cylindrical portion 22b of the body 22 (see FIG. 13). Preferably, the bushing support member 46 comprises a disk member 46a and an elongate cylindrical member 46b each produced by a stamping operation. One end of the elongate member 46b is inserted in and secured to the disk member 46a as by staking. Referring now to FIG. 4, the disk member includes a pair of diametrically opposed arcuate slots 46c and 46d and an indentation 46e disposed in the face 46f. A lubrication groove 46g extending from one end 46h and terminating in an aperture 46j, is produced in the inner surface of the elongate member 46b. The aperture 46j opens into the indentation 46e for permitting a lubricant to flow along a bushing 48. Preferably, the bushing support member 46 is pressed into the body 22 after the inlet valve and saddle assembly 44 is attached to the body 22. The bushing 48 is caused to be pressed into the cylindrical portion 46b of the bushing support member 46 which firmly supports the ends of the bushing 48 (see FIG. 13). The bushing 48 is adapted to journal the shaft (not shown) of a pump impeller (not shown). Although the bushing support member has been described as a two piece member, it should be noted that it may comprise a unitary member having a flange portion and an elongate cylindrical hub portion extending therefrom.

Figure 12:
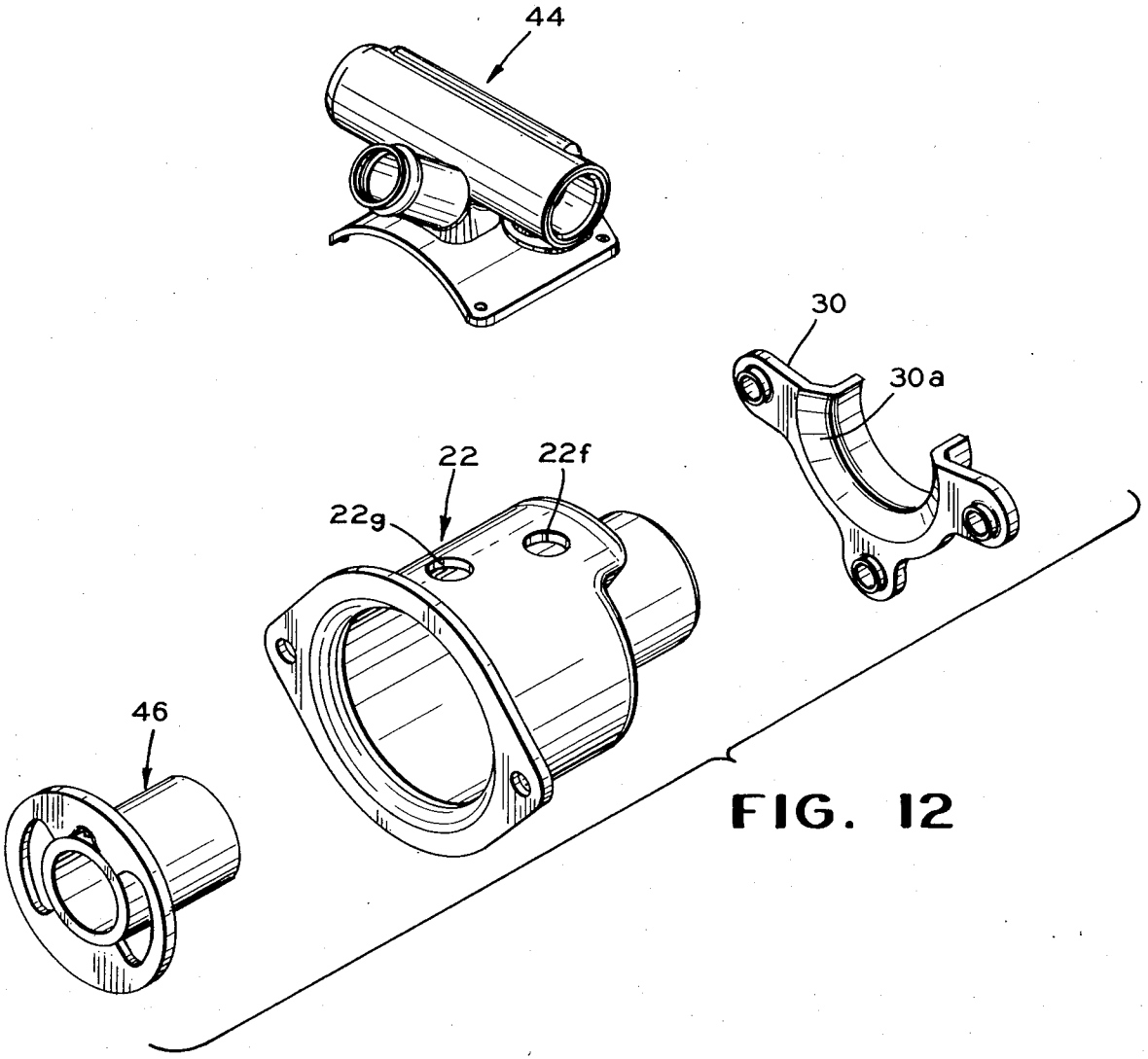
FIG. 12 is an exploded perspective view of the major components employed in the invention.

Referring now to the figures generally, and particularly to FIG. 12, the pump housing assembly 20 is constructed by orienting the body 22 with the aforedescribed inlet valve sleeve and saddle assembly 44 so that the apertured hub 36a extending therefrom is aligned with the port hole 22f of the body 22.

The aforedescribed inlet valve and saddle assembly 44 is then placed on the body 22 with the hub 36a of the plate 36 affixed to the saddle 24 projecting into the aperture 22f of the body 22 (see FIG. 15). The corners of the plate 24a of the saddle member 24 are then tack welded to the body 22.

Next, a yoke member 30, when one is to be used, is positioned on the body 22 and attached thereto, as previously described. The bushing support member 46 is caused to be pressed into the body 22 as illustrated in FIG. 13. Finally, the assembled components are copper-hydrogen brazed to each other for securely sealing all junctures of the assembled components.

The pump housing 20 is filled with hydraulic fluid from the reservoir 21g which is connected to the inlet tube 28. As illustrated in FIG. 15, hydraulic fluid passes into the cavity 24b' of the saddle member 24, then through the aperture 22g to fill the interior of the pump body 22. When a pump (not shown) is delivering pressurized hydraulic fluid to a power steering gear box 21c, the pressurized fluid flows from the interior of the pump housing body 22 into the bore of the valve sleeve assembly 26 and out an outlet orifice 26a (See FIG. 14). More specifically, pressurized hydraulic fluid passes from the interior of the pump body 22 through the apertures 46c and 46d in the disk member 46 into a cavity defined by the body portion 22c. The pressurized fluid then flows through an aperture defined by the apertured hub 36a of the plate 36 into the cavity 24c' thence through the aperture 40d opening into the bore of the valve sleeve assembly 26.

Figure 14:
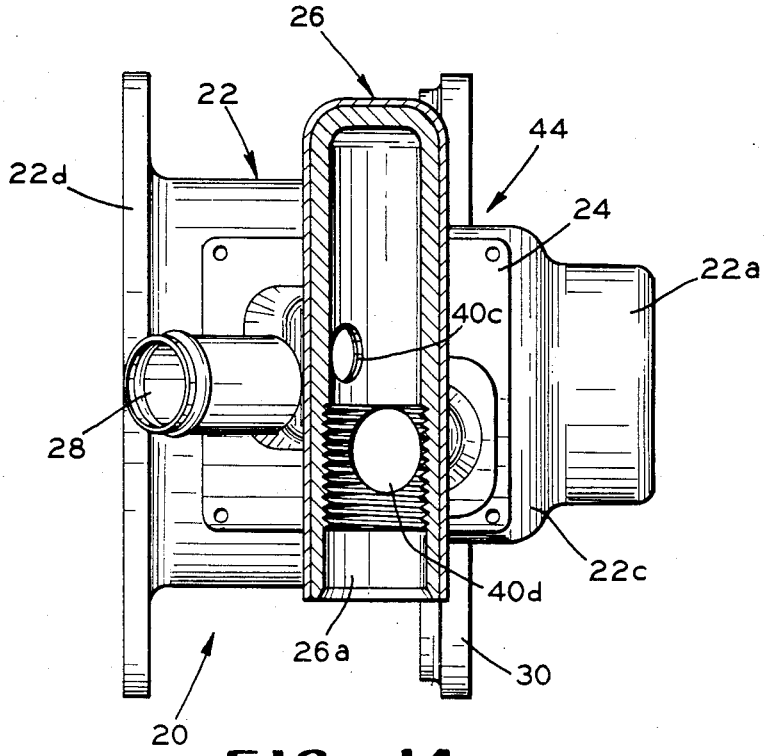
FIG. 14 is a transverse sectional view taken substantially along line 14—14 in FIG. 3 illustrating the interior of the valve sleeve assembly and its associated ports.

Referring now to FIGS. 11, 14 and 15, the bore of valve sleeve housing assembly 26 is adapted to receive a pressure relief and metering valve (not shown) for preventing the build-up of excessive pump pressures and purging of the hydraulic fluid from the body of the pump. As is known, the pressure relief valve normally directs the flow of pressurized fluid out the outlet orifice 26a. However, when the back pressure acting on the valve becomes excessive the valve moves to open the aperture 40c and dumps a portion of the pressurized fluid back into the pump body through the aperture 40c. It should be noted that the passageway 42 will permit the pressures acting on either side of a valve to equalize.

It will be appreciated from the foregoing description that the illustrated hydraulic pump housing assembly 20 results in a lightweight and extremely rugged structure. Further, it should be noted that heat energy generated by a pumping action of the assembly 20 will be dissipated more quickly through the walls of a drawn body than through the walls of a cast body. The inherent smooth surfaces of the interior walls of the assembly 20 produce an effective flow of hydraulic fluid resulting in a cooler operating and longer life pump. A drawn member such as the valve sleeve 38 permits a bore to have a high degree of finish as compared to a cast bore.

In accordance with the provisions of the patent statutes, the principle and mode of operation of the invention has been explained in what is considered to represent its preferred embodiment have been illustrated and described. It should, however, be understood that the invention may be practiced otherwise than as specifically illustrated and described without departing from the spirit and scope.

What I claim is

1. A process for producing a hydraulic pump housing assembly, comprising the steps of:

(a) producing a substantially hollow cylindrical pump body and forming an aperture in the cylindrical wall of the body;

(b) drawing an elongate sleeve assembly and forming at least one aperture in wall of the sleeve assembly;

(c) forming a saddle member with at least one aperture therein; and (d) securing the elongate sleeve assembly to the saddle member and fastening the saddle member to the outer peripheral surface of the cylindrical pump body with the apertures in communication with one another.

2. A process for producing a hydraulic pump housing assembly, comprising the steps of:

(a) drawing a substantially hollow cylindrical pump body having an aperture in the wall thereof from a circular blank;

(b) drawing an elongate valve sleeve with at least one aperture in the wall thereof;

(c) stamping an arcuate saddle member including a raised U-shaped portion having at least one aperture in the U-shaped portion;

(d) fastening the elongate valve sleeve to the raised U-shaped portion of the saddle member with the apertures therein aligned with one another; and (e) securing the arcuate portion of the saddle member to the cylindrical surface of the pump body with the aperture of the saddle member in communication with the aperture in the pump body.

3. The process defined in claim 2 wherein the valve sleeve includes a pair of apertures and the raised U-shaped portion of the saddle member includes a pair of corresponding apertures and including the step of extruding the material surrounding the apertures in the saddle member into the apertures in the valve sleeve whereby the valve sleeve is fastened to the saddle member.

4. The process defined in claim 2 wherein the valve sleeve includes a longitudinally spaced pair of aligned ports and including the step of inserting the vlave sleeve into a communication sleeve having a longitudinally extending passage whereby the ports are placed in communication with each other.

* * * * *